US011072921B1

(12) United States Patent
Mjelde

(10) Patent No.: US 11,072,921 B1
(45) **Date of Patent: *Jul. 27, 2021**

(54) DECK DRAIN SYSTEM

(71) Applicant: AquaStar Pool Products, Inc., Ventura, CA (US)

(72) Inventor: Olaf Mjelde, Ventura, CA (US)

(73) Assignee: AQUASTAR POOL PRODUCTS, INC., Ventura, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/148,009

(22) Filed: Jan. 13, 2021

Related U.S. Application Data

(63) Continuation of application No. 16/879,201, filed on May 20, 2020.

(60) Provisional application No. 62/851,518, filed on May 22, 2019.

(51) Int. Cl.

| | |
|---|---|
| ***E03F 5/00*** | (2006.01) |
| ***E03F 5/04*** | (2006.01) |
| ***E04H 4/06*** | (2006.01) |
| ***E04F 15/02*** | (2006.01) |

(52) U.S. Cl.
CPC ..... *E03F 5/0401* (2013.01); *E04F 15/02183* (2013.01); *E04H 4/06* (2013.01)

(58) Field of Classification Search
CPC ..... E03F 5/0401; E03F 5/06; E01C 11/22; E01C 11/224; E01C 11/227
See application file for complete search history.

(56) References Cited

U.S. PATENT DOCUMENTS

| | | | | |
|---|---|---|---|---|
| 2,449,265 | A * | 9/1948 | Williams | F01P 11/04 138/118 |
| 2,701,027 | A | 2/1955 | Scoville | |
| 3,465,654 | A | 9/1969 | Fox | |
| 3,815,213 | A | 6/1974 | Evans | |
| 3,876,322 | A | 4/1975 | Deason | |
| 4,007,566 | A | 2/1977 | Molitor | |
| 4,490,067 | A | 12/1984 | Dahowski | |
| 4,557,510 | A | 12/1985 | Overmyer | |
| 4,621,939 | A | 11/1986 | Thomann | |
| 4,640,643 | A | 2/1987 | Williams | |
| 4,787,773 | A | 11/1988 | Kehler | |
| 4,815,888 | A | 3/1989 | Stegmeier | |
| 5,181,793 | A | 1/1993 | Dekel | |

(Continued)

FOREIGN PATENT DOCUMENTS

| | | |
|---|---|---|
| EP | 3321421 | 5/2018 |
| EP | 1520942 | 11/2018 |

(Continued)

*Primary Examiner* — Benjamin F Fiorello
(74) *Attorney, Agent, or Firm* — Cislo & Thomas, LLP

(57) ABSTRACT

A modular deck drain system comprising a bottom channel and an upper cover. The bottom channel has a pair of opposed side walls and a bottom surface coupled to the side walls. The bottom channel also has a plurality of stabilizing members coupled to and extending from an external surface of the bottom channel, and at least one modular junction node. The upper cover is configured to couple to the bottom channel. The upper cover has two upper walls, each wall having a top end and a bottom end, and the top end of each wall is coupled to an upper lip. A narrow top opening is formed by the upper lips. The upper cover has at least one cutline.

13 Claims, 9 Drawing Sheets

(56) References Cited

U.S. PATENT DOCUMENTS

| | | | | |
|---|---|---|---|---|
| 5,380,121 | A | 1/1995 | Schluter | |
| 5,454,663 | A | 10/1995 | Stegmeier | |
| 5,529,436 | A | 6/1996 | Meyers | |
| 5,647,692 | A | 7/1997 | Gunter | |
| 5,718,537 | A | 2/1998 | Becker | |
| 5,810,513 | A | 9/1998 | Beamer | |
| 5,908,266 | A | 6/1999 | Miller | |
| 6,000,881 | A | 12/1999 | Becker | |
| 6,027,283 | A | 2/2000 | Schweinberg et al. | |
| 6,113,311 | A | 9/2000 | Becker et al. | |
| 6,280,117 | B1 | 8/2001 | Obermeyer et al. | |
| D466,596 | S | 12/2002 | Stegmeier, Sr. et al. | |
| 6,729,795 | B2 | 5/2004 | Dahowski et al. | |
| 6,746,179 | B1 | 6/2004 | Kerkhoff | |
| 6,792,723 | B2 | 9/2004 | Stegmeier | |
| 6,810,631 | B2 | 11/2004 | Kraft | |
| 7,264,418 | B1 | 9/2007 | Houck | |
| 7,534,071 | B2 | 5/2009 | Humphries et al. | |
| 7,637,694 | B1 | 12/2009 | Musser | |
| 7,794,176 | B2 | 9/2010 | Musser | |
| 7,866,911 | B2 | 1/2011 | Saadi | |
| 7,967,523 | B2 | 6/2011 | Hetzler | |
| D673,250 | S | 12/2012 | Luke et al. | |
| 8,469,631 | B2 | 6/2013 | Santi | |
| 8,708,603 | B2 | 4/2014 | Kerkhoff | |
| 2002/0057945 | A1 | 5/2002 | Dahowski | |
| 2002/0154952 | A1 | 10/2002 | Gunter | |
| 2005/0055887 | A1 | 3/2005 | Benesteau | |
| 2005/0074294 | A1 | 4/2005 | Albone | |
| 2005/0223581 | A1* | 10/2005 | Hale | G01B 3/02 33/758 |
| 2007/0166105 | A1 | 7/2007 | Rzadkowolski | |
| 2009/0308476 | A1* | 12/2009 | DeMartino | F16L 9/12 138/104 |
| 2011/0104418 | A1* | 5/2011 | Fish | G01B 3/04 428/36.9 |
| 2017/0241121 | A1 | 8/2017 | Files, Jr. | |

FOREIGN PATENT DOCUMENTS

| | | |
|---|---|---|
| EP | 2899325 | 8/2019 |
| GB | 2448664 | 10/2008 |

* cited by examiner

DECK DRAIN SYSTEM

CROSS-REFERENCE TO RELATED APPLICATIONS

This U.S. Non-Provisional Patent Application is a continuation of U.S. Non-Provisional Patent Application No. 16/879,201, titled "Deck Drain System," filed May 20, 2020, which claims the benefit of U.S. Provisional Patent Application Ser. No. 62/851,518 entitled "Deck Drain Slot Cover System" filed May 22, 2019, wherein both applications are incorporated in their entirety herein by this reference.

BACKGROUND

Deck drains are a useful feature of any pedestrian traffic area around in-ground pools, spas, or at water parks and the like. Commonly such deck drains are embedded into the concrete surface surrounding the pool or other recreational-built-in-the-ground water source. The purpose of deck drains is to eliminate excess water from collecting on the surrounding surface where an individual may slip and fall due to the deck being slippery. This is particularity critical where pedestrian traffic is at a high volume, or where especially venerable individuals such as the young and elderly, might congregate.

Deck drains are designed such that excess or overflow water from the water source flows from the surrounding deck and into a channel internal to the drain. Once the water has passed into the channel it then flows either to an outlet location of gravel or elsewhere the water no longer poses a slip and fall risk.

Conventional deck drains known in the art are typically wide at the top, the width of the top being equal to the width of the underlying water flow channel. See FIG. 1 showing such prior art deck drain as it would be installed into a concrete deck. At the top, it is common to have a cover with perforations or slots which allow the excess water to flow into the channel and away to a harmless outlet location. Such designs tend to occupy a large visual area around a pool or other water source. While critical for safety, they tend to be highly unsightly due to the visual border created around a pool resulting from the large width of the drain cover.

Further, deck drains known in the prior art tend to clog with sand, dirt, and other debris. While some deck drains known in the prior art have removable covers which allow for easier maintenance, these drains with removable covers tend to be expensive and the covers become brittle over time and prone to breaking. For deck drains which do not have removable covers, clearing the internal channel can be a tedious and time-consuming process. When such routine maintenance fails, clogs result which may cause the channel to overflow onto the deck, giving rise to a safety issue.

What is needed is a deck drain system which is highly effective at removing excess water, is easily cleared and cleaned, and that is also low profile. These features would be highly desirable for deck drains around pools and other recreational water sources.

SUMMARY

The invention described herein is directed to a deck drain system having a bottom channel and an upper cover configured to couple to the bottom channel.

The bottom channel has an open top, a pair of opposed side walls, a bottom surface, a plurality of stabilizing members coupled to and extending from an external surface of the bottom channel and at least one modular junction node.

The upper cover has two upper walls, each wall having a top end and a bottom end, wherein the top end of each wall is coupled to an upper hp. A narrow top opening formed is by the upper lips. The upper cover has at least one cutline.

Ideally, the bottom channel further comprises a plurality of fastener points spaced along the bottom channel.

Ideally, the modular junction node comprises at least two modular junction fasteners coupled to an end of the bottom channel, and at least two modular junction receivers coupled to an other end of the bottom channel.

Ideally, the two upper walls of the upper cover are slanted.

Ideally, the upper cover further comprises a plurality of upper cover fill holes spaced along the upper walls. The fill holes are configured to retain decking material and each fill hole has an open top and a closed bottom.

Ideally, the upper cover further comprises a plurality of upper cover mounting apertures spaced along the two slanted upper walls and a plurality of upper cover fasteners for placement within the upper cover mounting apertures.

Ideally, my deck drain system further includes a shield for removably coupling to the top opening in the upper cover. The shield is configured to rest within and seal the top opening.

Ideally, my deck drain system further comprises a female spigot coupled to the outflow aperture.

Ideally, my deck drain system further comprises a male spigot coupled to the outflow aperture.

The invention described herein is also a method of installing my deck drain system. The method comprises the steps of a) cutting the system along the outline; and b) forming a corner using the cut system.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION

Figure 1:
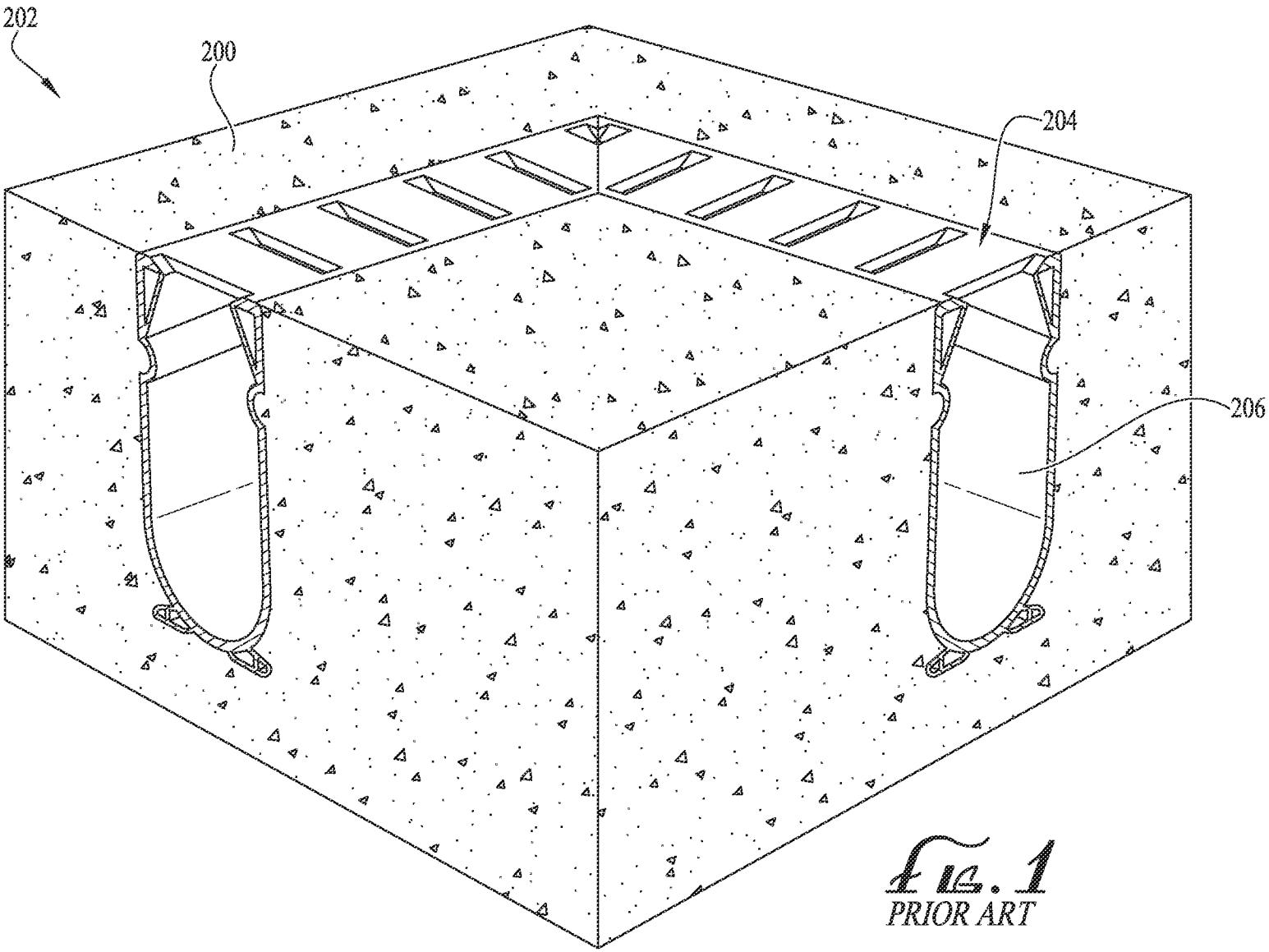
FIG. 1 PRIOR ART
FIG. 1 is a perspective view showing a conventional deck drain of the prior art installed in a concrete deck.

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any system, any device or part of a device disclosed in this disclosure will be determined by its intended use.

Referring now to the drawings, like reference numerals designate identical or corresponding features throughout the several views. Further, described herein are certain non-limiting embodiments of a deck drain system 100 for draining water from a substantially flat hardened deck surface 200.

Referring to FIG. 1, there is shown a deck drain system 202 according to the prior art. The deck drain system 202 has a wide top opening 204 that is substantially flush with a deck surface 200 around the drain 202, and a bottom channel 206 that is approximately the same width as the top opening 204. The large width of the top opening 204 is unsightly. Additionally, the grate configuration can make the drain 202 difficult to clean.

Figure 2:
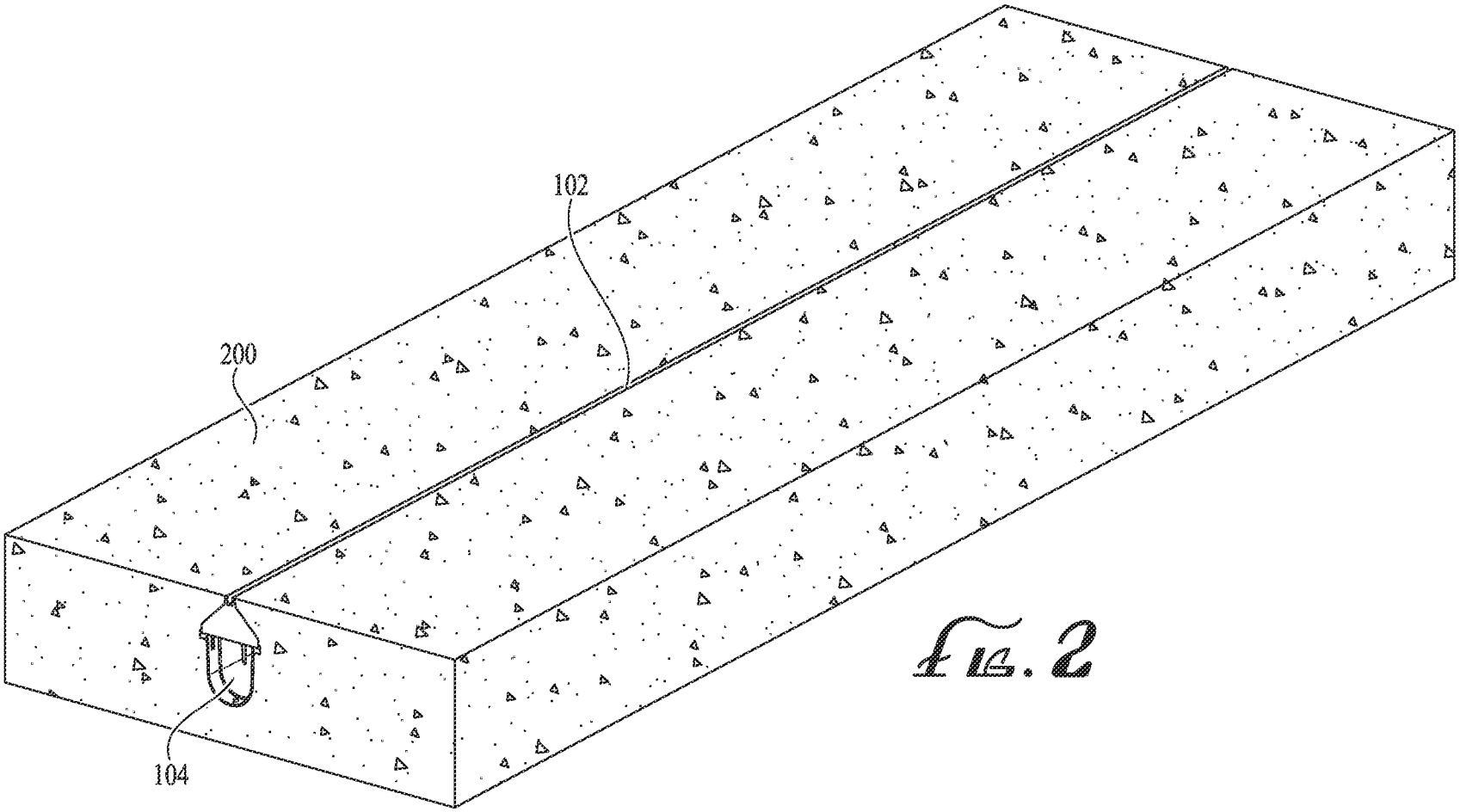
FIG. 2 is a perspective view of my deck drain system installed in a concrete deck.

Referring to FIG. 2, there is shown my deck drain system 100. The drain 100 is fully embedded into a hardened deck surface 200. The deck drain system 100 has an upper cover 106 forming a top opening 102, a bottom channel 116 coupled to the upper cover 106, and an outflow aperture 104. Because the drain 100 is fully embedded into the hardened deck surface 200 in FIG. 2, only the top opening 102, the outflow aperture 104, and hardened deck surface 200 are visible. The desired narrowness of the top opening 102 with respect to the rest of the drain 100 can be seen. The surrounding deck material which constitutes the hardened deck surface 200 may be made with any material which can be poured in a liquid state and which then may harden into a hardened material. By way of non-exhaustive example only, the hardened deck surface 200 may be constructed of concrete, hempcrete, ferrock, ashcrete, greencrete, resins, or other similar materials.

Figure 3:
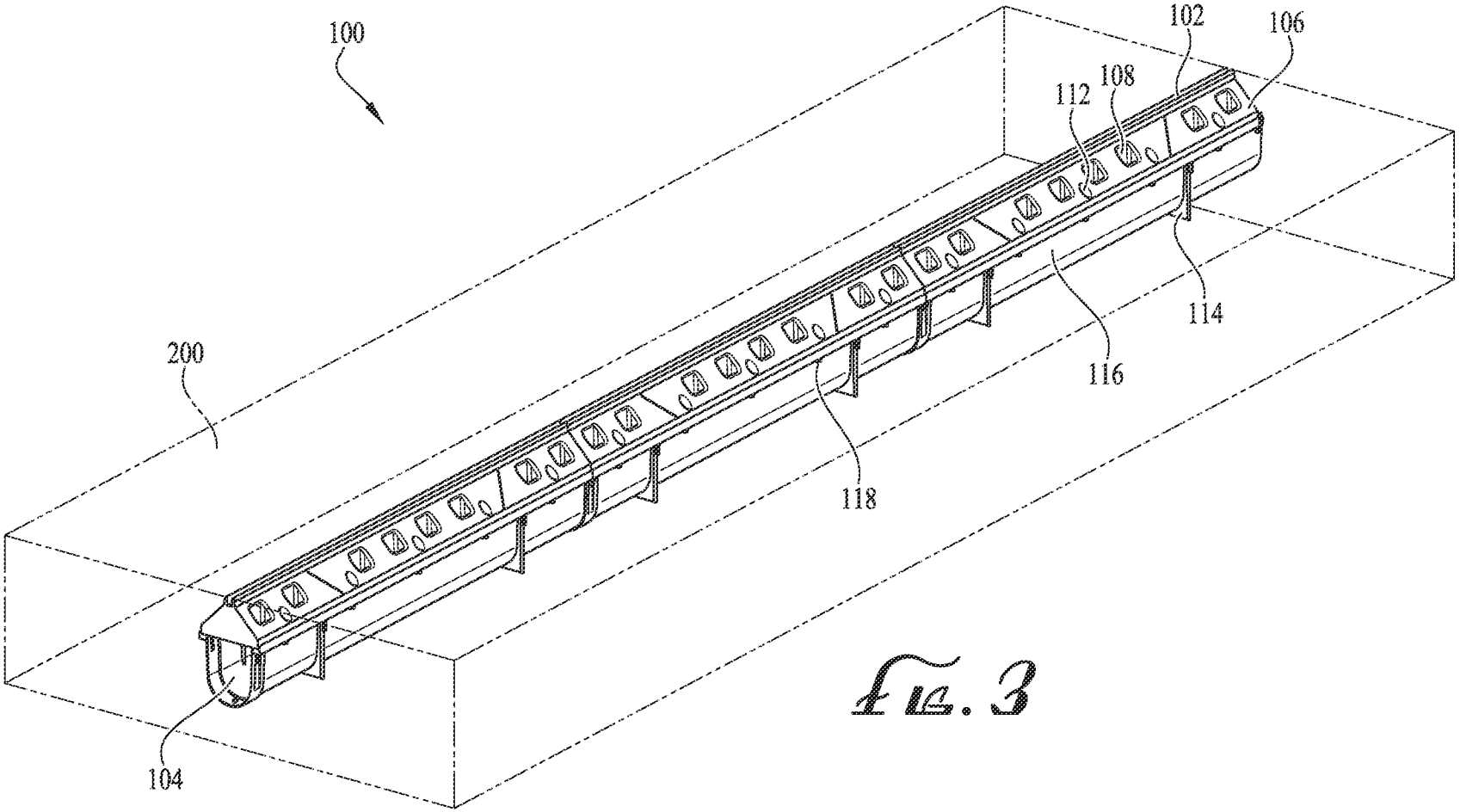
FIG. 3 is a perspective cutaway view of a concrete deck showing my deck drain installed therein.

Referring now to FIG. 3, shown is the deck drain system 100 with the hardened deck surface 200 as a transparent overlay showing how my deck drain system 100 might be positioned within the hardened deck surface 200. Further shown is the upper cover 106 which has a multiplicity of upper cover fill holes 108. The upper cover fill holes 108 may be filled in by the liquid phase of the hardened deck surface. Such filling may allow for increased stability and slide resistance when installed into a hardened deck surface 200.

Figure 4:
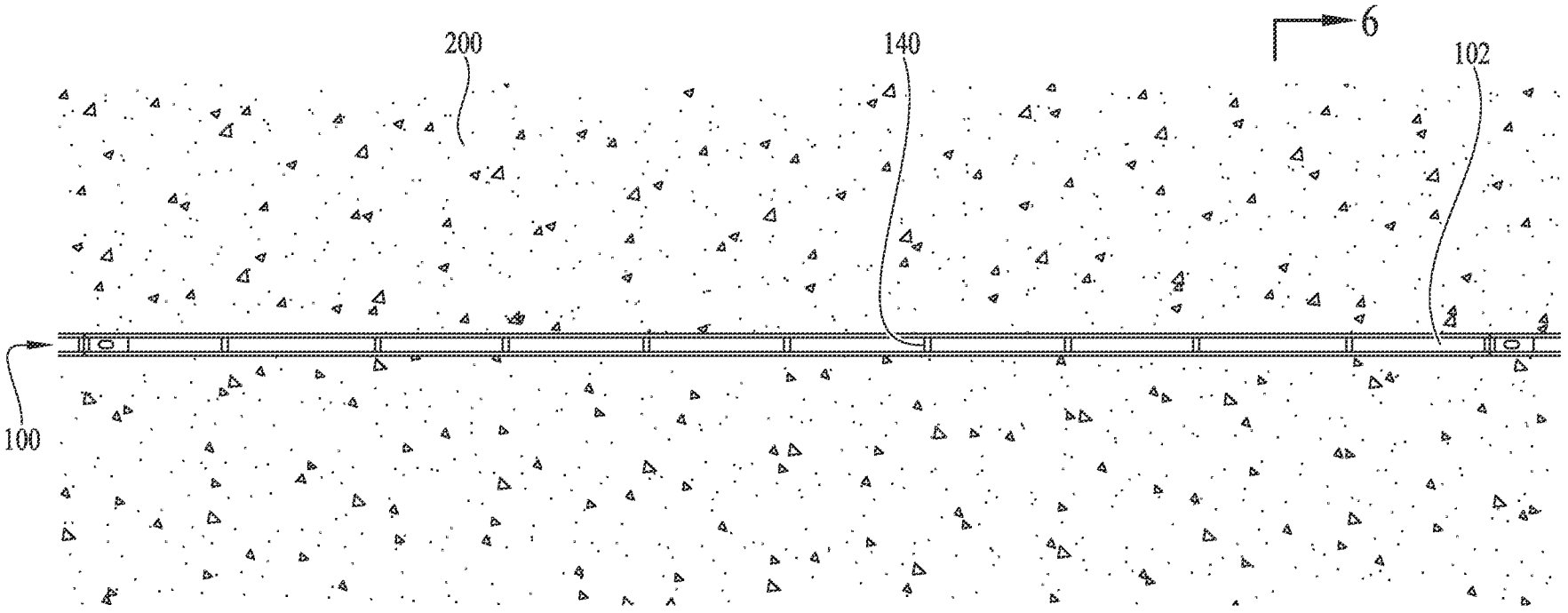
FIG. 4 is a top view of a drain slot of my deck drain system as it may be viewed alter installation into the concrete deck.

Referring to FIG. 4, there is shown a top view of the deck drain system 100. The hardened deck surface 200 is shown surrounding the top opening 102. Illustrated in FIG. 4 is the narrow character of the top opening 102. This narrow characteristic of top opening 102 is better illustrated and understood with a comparison of FIG. 1. As discussed above, shown in FIG. 1 is one example of a prior art drain 202. As compared to the prior art drain 202, the top opening 102 of my system 100 is less unsightly having a more sleek profile than the commonly used wider openings as illustrated by the prior art drain 202. The narrow character of the top opening 102 of my system 100 is desirable both from an aesthetic perspective as well as a functional perspective. The narrow top opening 102 results in a smaller surface area which can be harder to crack or break due to too much weight being applied.

Figure 5:
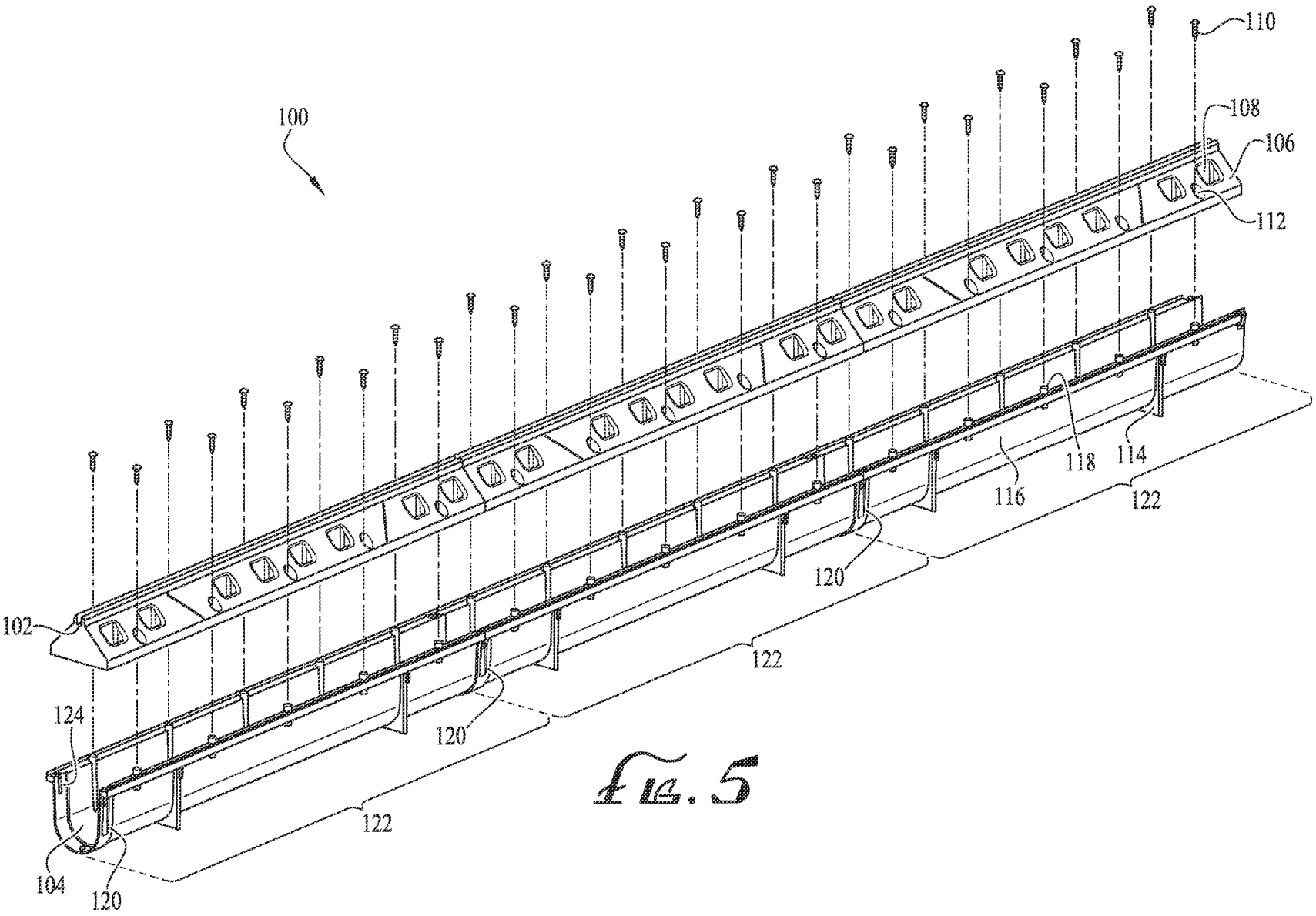
FIG. 5 is an exploded view of my deck drain system.

Referring to FIG. 5, there is shown an exploded view of my deck drain system 100. The relevant portions displayed in FIG. 5, are the outflow aperture 104, the upper cover 106, the multiplicity of upper cover fill holes 108, a multiplicity of upper cover fasteners 110, a multiplicity of upper cover mounting apertures 112, a multiplicity of stabilizing members 114, and the bottom channel 116.

The upper cover 106 is roughly triangular in shape, having two slanted upper outer walls 129A, 129B, The slanted outer walls 129A, 129B provide a surface for catching and retaining the decking material 200. The upper cover 106 may be reversibly connected to the bottom channel 116 by way of using upper cover fasteners 110. The upper cover fasteners 110 may be deployed into the upper cover mounting apertures 112 and into the bottom channel 116.

The bottom channel 116 may further have a multiplicity of fastener points 118. The fastener points 118 are select points where the upper cover fasteners 110 may find a mating location. The upper cover fasteners 110 may be of any number of fasteners used in the industry, including screws, rivets, or bolts. By way of example, the fastener points 118 may include a female thread which may threadably connect with a male thread pattern to the outer surface of an upper cover fastener.

Still referring to FIG. 5, upon connecting the upper cover 106 to the bottom channel 116 a portion is thereby ready for placement such that the top opening 102 is at substantially the same height, and substantially level with, the hardened deck surface 200. The multiplicity of stabilizing members 114 are flanges that extend from an exterior surface of the bottom channel 116. The stabilizing members 114 aid in the installation process by stabilizing the drain system 100 and keeping the system 100 plum while the liquid phase of the hardened deck surface 200 is poured around a deck drain system 100. Each stabilizing member 114 extends under the drain 100, forming a plurality of flat surfaces on which the drain 100 rests.

Further shown in FIG. 5 is a modular junction node 120. The section of deck drain system 100 between two modular junction nodes 120 may constitute a drain module 122. One drain module 122 may contain all necessary portions to constitute a section of a deck drain system 100. Illustrated in FIG. 4 are three modules 122 releasably connected together. Thus, with each additive drain module 122, the overall length of a deck drain system 100 may be increased until the desired overall length has been achieved. The modular junction node 120 may contain modular junction fasteners 124A as further illustrated in FIG. 13. The modular junction fasteners 124A may be clips, screws, rivets, bolts, or other fasteners commonly used in the industry. The modular junction nodes 120 are shown and described in more detail in FIG. 13.

Figure 6:
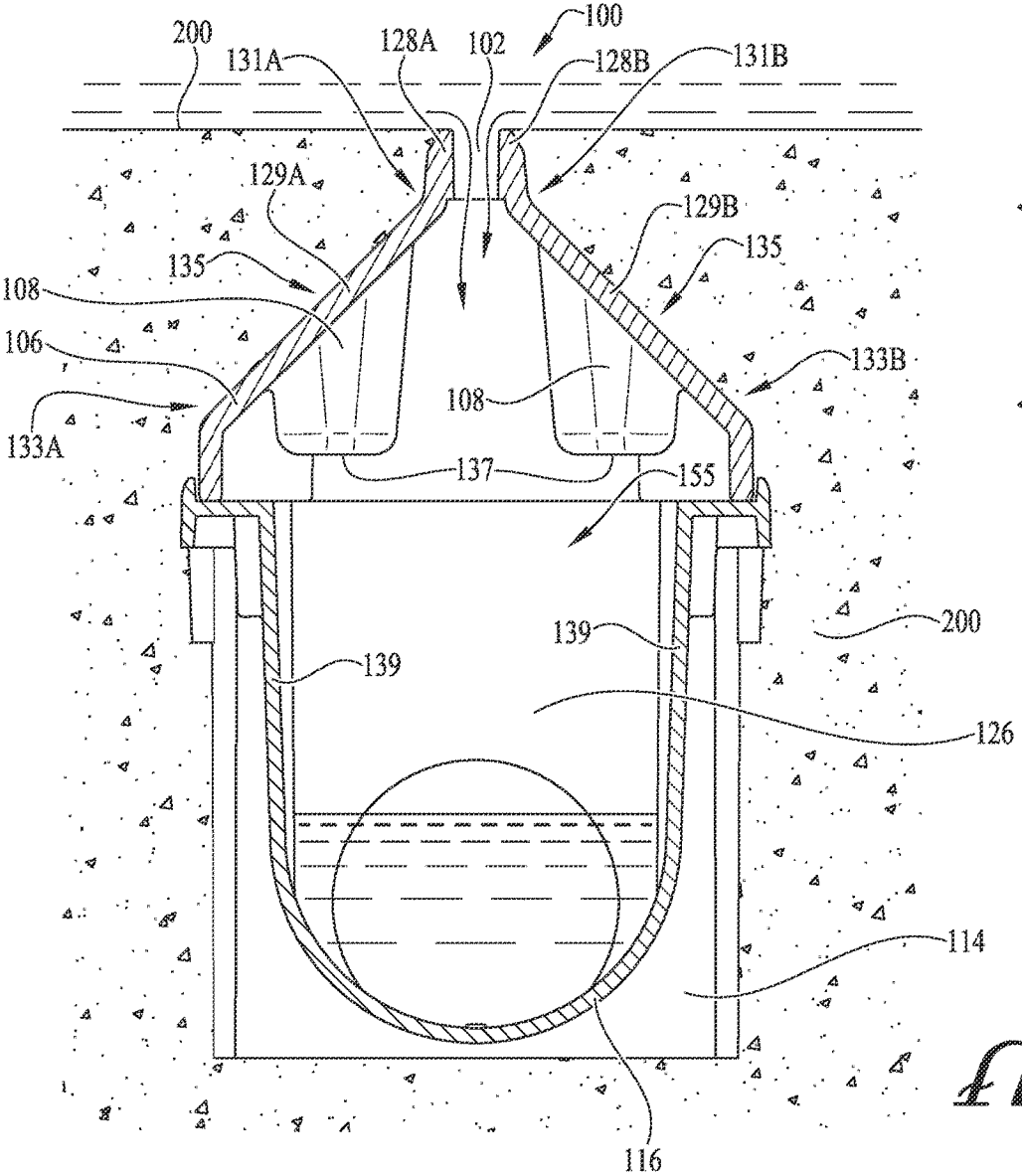
FIG. 6 is a cross-sectional view of my deck drain system also illustrating water flow.

FIG. 6 illustrates a cross-sectional view of the deck drain system 100. Shown in FIG. 6 is top opening 102 with an illustrative flow of water through top opening 102 to bottom channel 116. The water may then flow along the bottom channel 116 to an outflow aperture 104 (not shown) along the central flow hollow 126. The bottom channel 116 has an open top 155, opposed side walls 139, and a curved bottom surface 141 to facilitate draining of water from the channel 116. Preferably, the side walls 139 are slanted slightly outward, from bottom to top, to further facilitate draining of water from the drain 100.

As noted above, upper cover 106 is roughly triangular in shape, having two slanted upper walls 129A, 129B. Each wall 129 has a top end 131A, 131B, and a bottom end 133A, 133B. The top ends 131 of the walls 129 are proximal each other and the bottom ends 133 are distal each other. The bottom ends 133 form an open bottom of the upper cover 106. Extending from the top end 131 of each wall 129 is an upper lip 128A, 128B. The upper lips 128 extend vertically, away from the top end 131 of each wall. The upper lips 128 form the narrow top opening 102 of the drain system 100.

A preferable example of the height of the upper lip 128 is shown in FIG. 6. In preferred embodiments, the upper lip 128A will be paired with a substantially identical upper lip 128B on an opposing side. The distance between the first upper lip 128A and a second upper lip 128B may be ideally one-quarter of one inch but may be further contemplated to vary in width. The height of upper lips 128 may be substantially at the same height as the surface of the hardened deck surface 200. The substantial matching of the two respective heights is preferable because it will not impede water flow into the top opening 102 nor will it be detectable by users of any nearby recreational water sources.

FIG. 6 also shows the upper cover fill holes 108 in greater detail. Each fill hole 108 is a recess in which liquid decking material 200 can pour into and then harden. The fill holes 108 have open tops 135 for receiving decking material 200 and closed bottoms 137 for retaining decking material 200.

Figure 7:
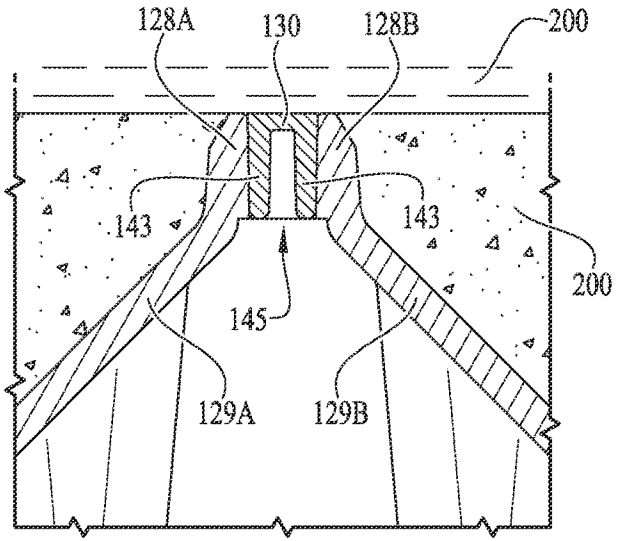
FIG. 7 is an enlarged cross-sectional view of a top portion of a deck drain cover for my deck drain system.

Shown in FIG. 7 is the use of a shield 130. The shield 130 is used to prevent the liquid portion of the hardened deck surface 200 from intruding into the space of the top opening 102. The shield 130 may preferably be placed into the top opening 102 during installation at the same time that plumb is being achieved with the aid of the plurality of stabilizing members 114. Once plumb is achieved, the liquid phase of the hardened deck surface 200 may be poured with confidence that shield 130 will prevent inflow into the bottom channel 116 through top opening 102. The shield 130 can be any shape that securely closes off the top opening 102 and prevents liquid deck material from entering the drain 100. Preferably, the shield 130 has a cross-section that is shaped like an upside-down U, as shown in the FIGS., where the shield 130 has two legs 143 that extend downward and rest on an internal ledge 145 in the top opening 102. The contact with ledge 145 allows the shield 130 to support the weight of liquid deck material and prevents the shield 130 from collapsing under that same weight.

Figure 8:
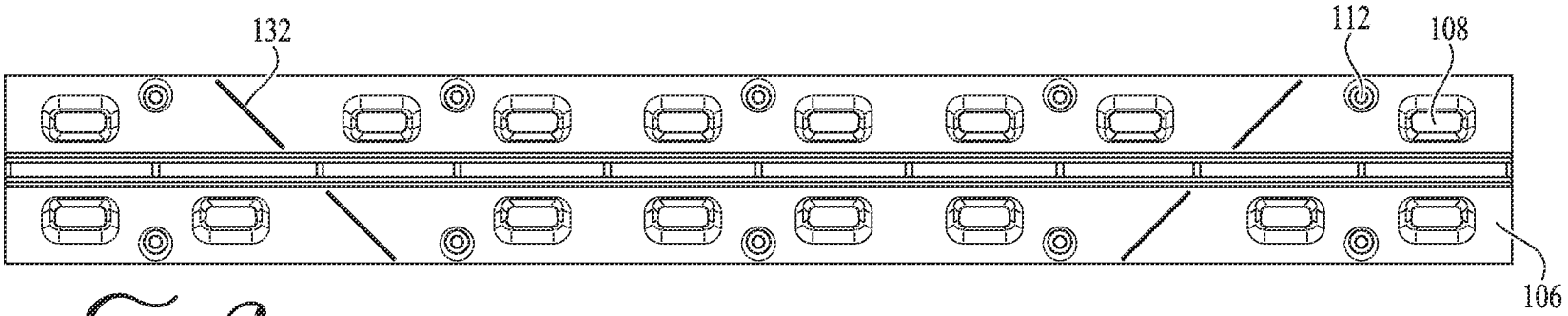
FIG. 8 is a top view of a first embodiment of the upper cover of my deck drain system.
Figure 9:
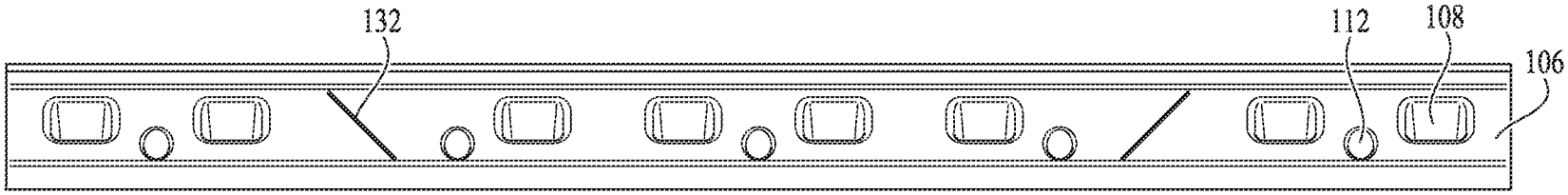
FIG. 9 is a side view of the upper cover of my deck drain system shown in FIG. 8.
Figure 10:
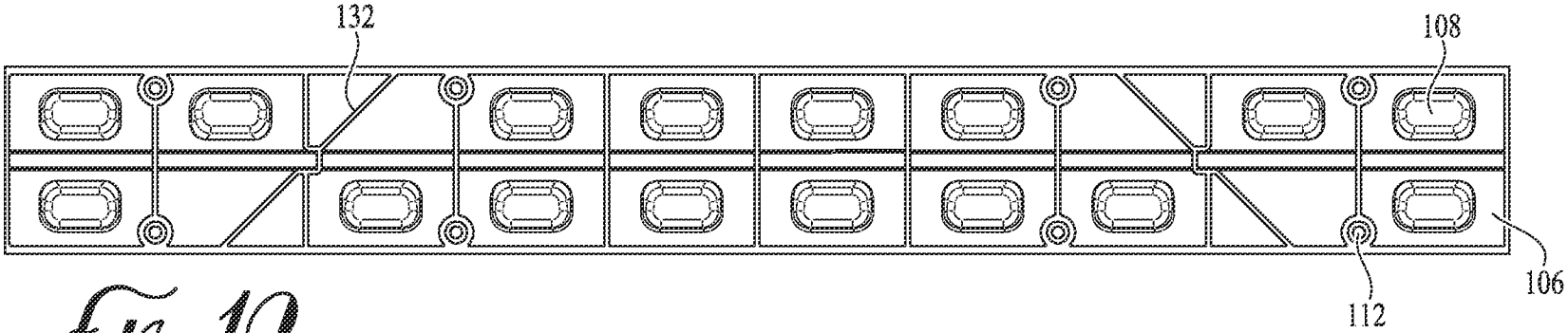
FIG. 10 is a bottom view of the upper cover of my deck drain system shown in FIG. 8.

FIGS. 8, 9, and 10 show various views of particular embodiments of the upper cover 106. Specifically, FIG. 8 shows a top view of the upper cover 106. FIG. 9 shows a side view of the upper cover 106 of FIG. 8, and FIG. 10 shows a bottom view of the upper cover 106 of FIG. 8, Further, each of FIGS. 8, 9 and 10 may represent one drain module 122 upper cover 106. Of particular importance in each figure is cutline 132. Cutline 132 may serve as a general guide to making a substantially perfect forty-five-degree miter cut on module 122. The cutline 132 is not a required cut point, and any angle may be cut from upper cover 106 that is desired from an individual installing the deck drain system 100. This is because the drain 100 is modular, and as noted above, each module 122 contains all necessary parts of the system 100. This makes the drain 100 fully customizable without any special equipment—just a saw to make the desired cuts. This advantage is shown and discussed in greater detail in FIGS. 13 through 16.

Figure 12:
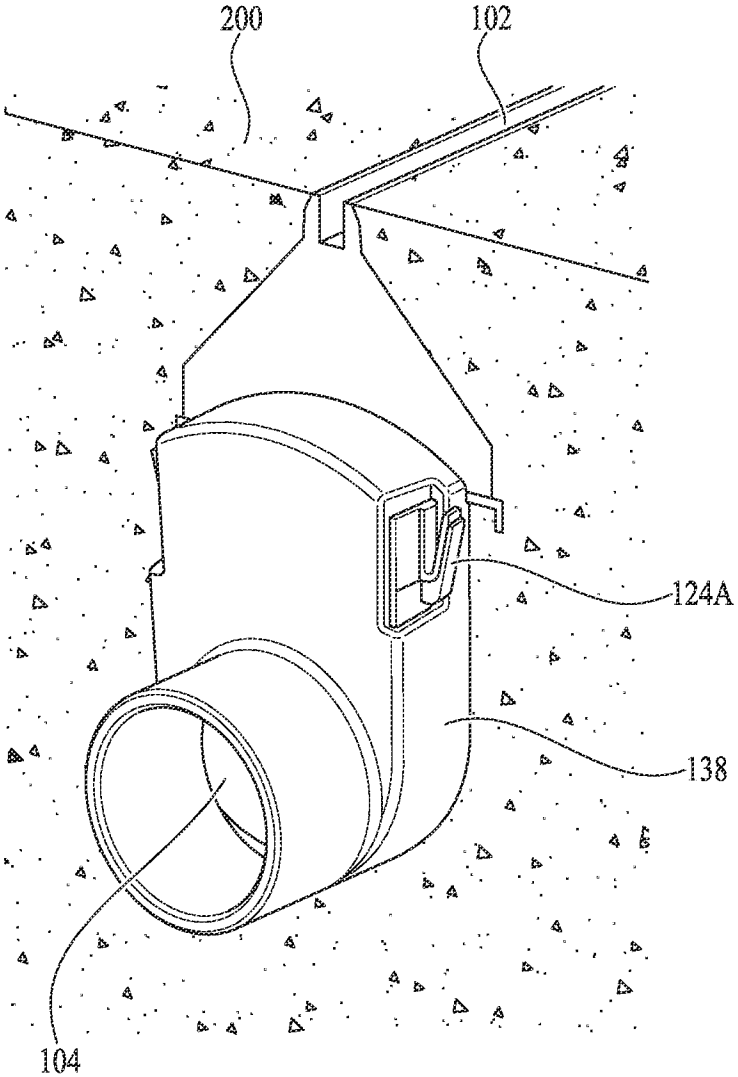
FIG. 12 is a perspective view of one end of an embodiment of my deck drain system.
Figure 11:
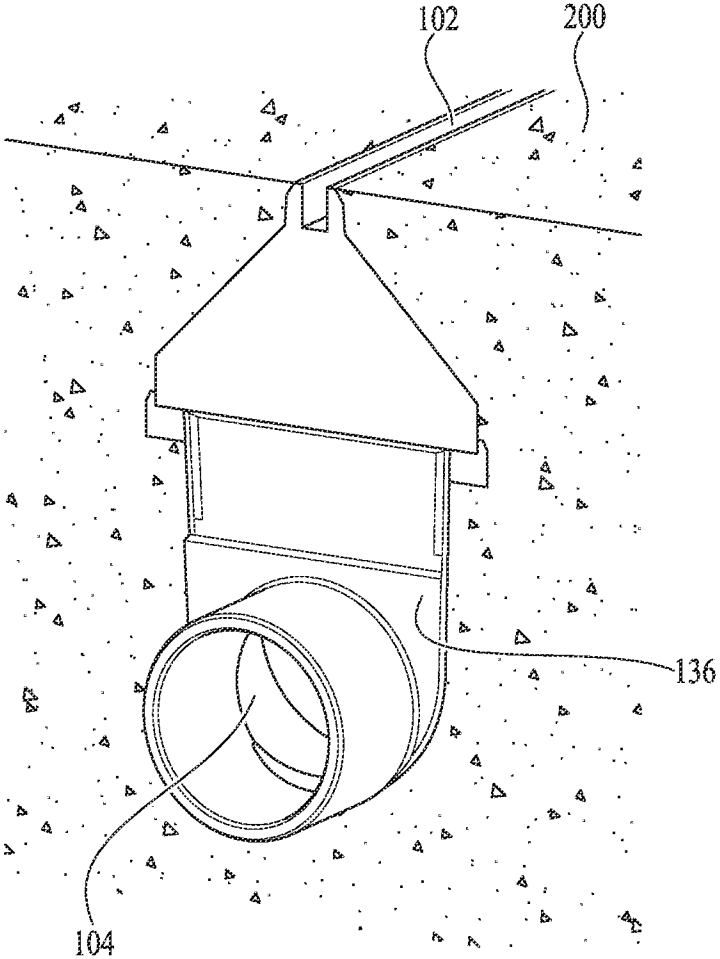
FIG. 11 is a perspective view of one end of an embodiment of my deck drain system.

Referring now to FIG. 11 is a female spigot 136. The female spigot 136 may constitute one end of the deck drain system 100 and further defines outflow aperture 104. Further, the female spigot 136 may couple with the male spigot 138 shown in FIG. 12. Additionally, either the female spigot 136 shown in FIG. 11 or the male spigot 138 shown in FIG. 12 may be coupled with plumbing commonly known in the industry to divert water flow further from the edges of a hardened deck surface 200.

The male spigot 138 may be further distinguishable from female spigot 138 because male spigot 138 may have modular junction fasteners 124A which allow for additional drain modules to be additively coupled together. Modular junction fasteners 124A mate with corresponding modular junction receivers 124B (best shown in FIG. 13), Together, modular junction fasteners 124A and modular junction receivers 124B form a modular junction node 120 which provides a removable coupling mechanism for removably coupling a plurality of modules 122 together.

Figure 13:
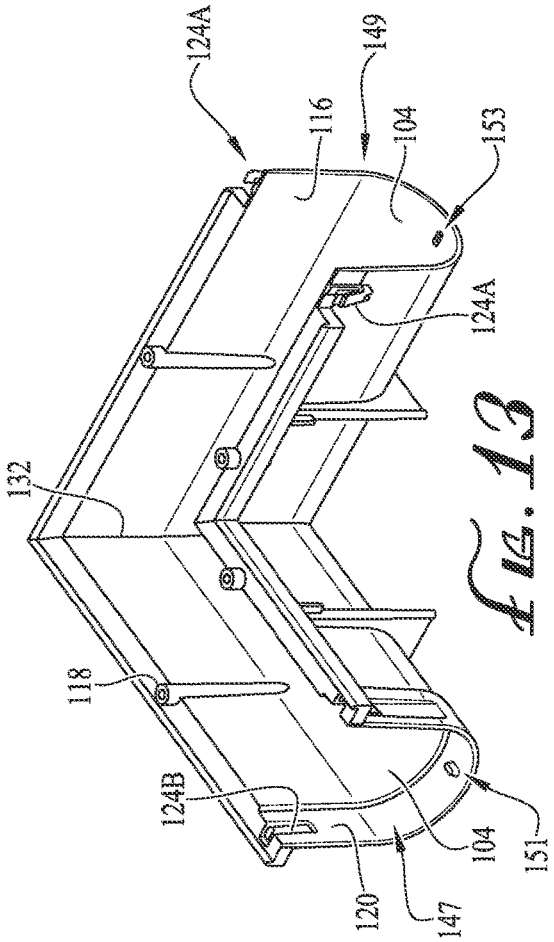
FIG. 13 is a perspective view of a corner of an embodiment of my deck drain system.

FIG. 13 shows one contemplated way that the deck drain system 100 could turn a corner. Illustrated in FIG. 13 is a ninety-degree turn to bottom channel 116. This ninety-degree turn may be achieved by cutting any portion of the deck drain system 100 at a predetermined cutline 132. Alternatively, a cut is contemplated at a location other than at cutline 132, as cutline 132 may be used for general guides to increase ease of installation. Once the drain system 100 has been cut as desired, the cut ends are mated together. The cut ends can be mated together by a variety of methods, including but not limited to, standard solvent cement, mechanical fasteners, clamps, bolts, etc.

Figure 14:
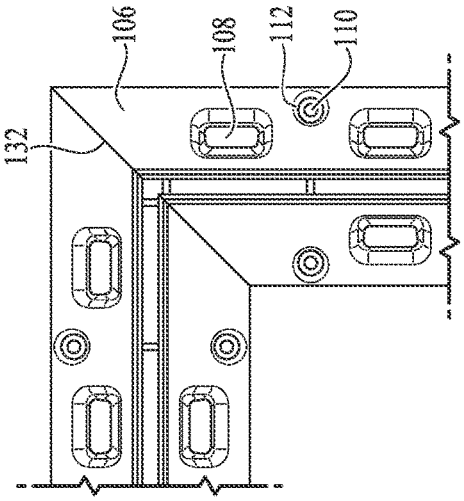
FIG. 14 is a top view of a potential junction point of my deck drain system.
Figure 15:
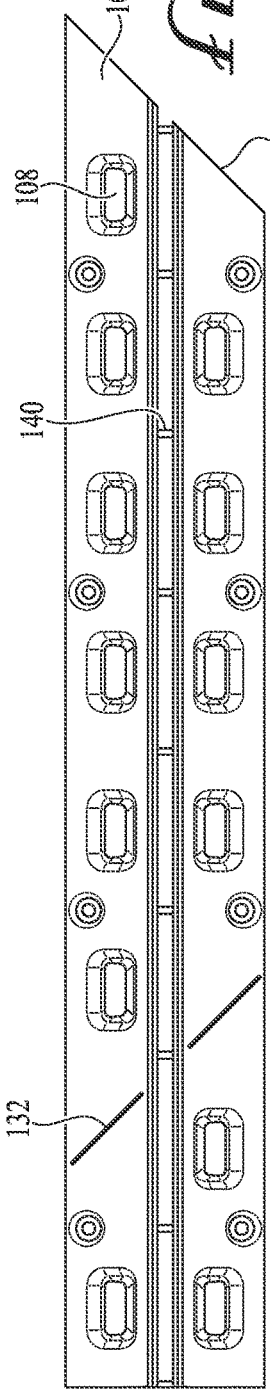
FIG. 15 is a top view of an embodiment of an upper cover of my deck drain system, further showing a miter cutline; and, FIG. 16 is a bottom view of an embodiment of upper cover of my deck drain system, further showing a miter cutline.
Figure 16:
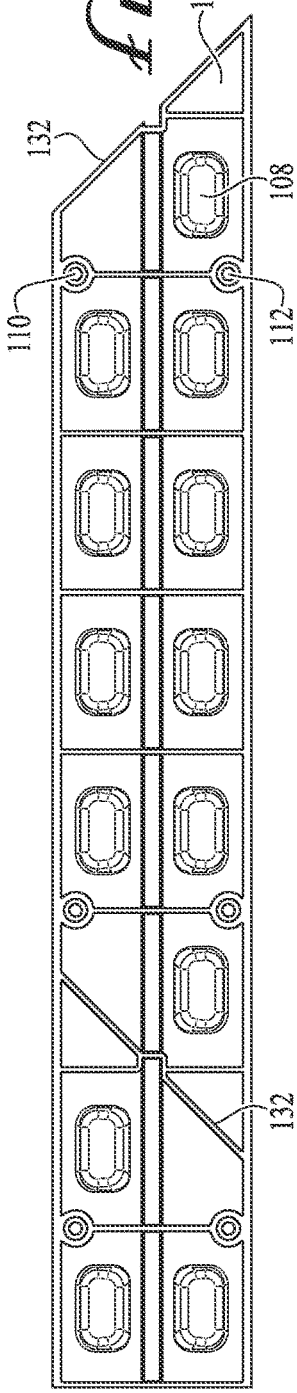

When FIG. 13 and FIG. 14 are viewed in conjunction with FIG. 15 and FIG. 16 it becomes apparent how cutline 132 may be used during installation. FIG. 14 is a top view of the deck drain system 100 with a ninety-degree turn. The bottom channel 116 is not shown in FIG. 14 due to the top perspective view but may be located below upper cover 106 and attached as described above. The upper cover 106 may still be applied to the bottom channel 116 such that all relevant attachment points line up, even where installers do not cut the deck drain system 100 at cutline 132. Further, while the cutline 132 generally notes forty-five-degree angles, cutting angels either acute or obtuse to a reference of forty-five degrees will generate a different final turn for the deck drain system 100.

Also shown in FIG. 13 is the modular junction node 120 in greater detail. Preferably, although not necessary, each module 122 has two opposed ends, and each end has a portion of the modular junction node 120 coupled to it. One end of the module 122 can be female and the other end can be male. As seen in FIG. 13, the female end comprises a recessed ledge 147 and the male end comprises an extending lip 149. The recessed ledge 147 is configured to matingly receive the extending lip 149 of another module 122. The recessed ledge 147 further includes a projection 151 for mating with an opening 153 positioned in a corresponding extending lip 149. Additionally, each recessed ledge 147 also includes two modular junction receivers 124B, one receiver 124B positioned in an upper portion of each side wall 139. Each receiver 124B is a recess that is configured to receive and retain a corresponding modular junction fastener 124A. Each modular junction fastener 124A is a biased clip that snaps into a corresponding receiver 124B.

FIG. 15 and FIG. 16 are illustrative of drain module 122 with a portion of module 122 removed at cutline 132. Specifically, FIG. 15 illustrates the aforementioned from the top view of an upper cover 106, while FIG. 16 illustrates the aforementioned from a bottom view of an upper cover 106. Illustrated here is that by joining two opposing forty-five-degree angels together, a ninety-degree angle can be achieved by using cutline 132. Further illustrated in both FIG. 15 and FIG. 16 is a multiplicity of rib 140. Rib 140 is used to further enhance the structural integrity of the upper cover 106 and maintain a uniform space of the top opening 102 between two upper lips 128 down a length of a deck drain system 100.

Having disclosed the structure of the preferred embodiments, it is now possible to describe its function, operation, and use. One important aspect of the installation may be the modular design of the deck drain system 100. As mentioned, drain module 122 may be additively combined with each other until a necessary length is reached for installation requirements. Between the use of additive application of drain module 122 and cutline 132, or other impromptu alternative cut locations, installers may encircle, arch, or otherwise enclose all of a water source or part of a water source as may be needed or desired by the end user.

The deck drain system 100 may be further installed by then preparing a concrete form around an area of installation. The concrete forming process may follow processes known in the industry. The concrete forms may be of such a depth that the upper lip 128 is at substantially the same height as the anticipated height of the top of the hardened deck surface 200. This is important for proper water control and flow into the central flow hollow 126. The deck drain system 100 may be placed into the formed area with as many drain modules 122 attached in series as may be required to reach a necessary length of the drain 100. Corners may then be cut from cutline 132 or, in the alternative, cuts may be made either obtuse or acute with respect to a cutline 132. This process of laying drain modules 122 and turning corners may be repeated until the entirety of the deck drain system 100 has been laid out.

The installers are to ensure that the shield 130 is properly placed into the top opening 102 at some time prior to pouring concrete such that no concrete or other pourable material enters into the deck drain system 100 and later hardens blocking off water flow in the central flow hollow 126 as illustrated in FIG. 5. Then the installers may pour concrete or other pourable material and proceed as is commonly understood in the industry. The upper cover fill holes 108 may operate as negative space for a positive concrete hook to occupy during the pouring of the concrete. When the negative space of the upper cover fill holes 108 are filled in with concrete, no lateral movement may occur in the deck drain system 100 subsequent to hardening. This hook would be substantially continuous with the larger body of the hardened deck surface 200. The hook may prevent any movement by the deck drain system 100 after the concrete or other pourable material has become hard.

Maintaining, cleaning, and keeping the deck drain system 100 clear may occur by use of a garden hose or other high-pressure power washer. FIG. 2 shows that an advantage of the deck drain system 100 is the top opening 102. The top opening 102 travels parallel to the deck drain system 10, i.e., down the length of the deck drain system 100. The present disclosure's top opening 102 is thus considerately different relative to many of the perpendicular grates of the prior art deck drain 202 shown in FIG. 1. The perpendicular grate of the prior art deck drains 202 makes cleaning difficult for the end user of that prior art deck drain 202. Some users of the prior art deck drain 202 have even resorted to cutting into the top grate to gain better access of the channel below.

Contrastingly, the top opening 102 of the present disclosure has a nearly continuous opening down the length of the upper cover 106, with the only blocking point being the rib 140. The rib 140, as shown in FIG. 2, is minimized to such a degree that a power washer or garden hose would have little difficulty in clearing the top opening 102 and the bottom channel 116 from obstruction. Alternatively, an end user of the deck drain system 100 has the option of snaking a garden hose or high-pressure washer hose into an outflow aperture 104. Having such a wide range of possible cleaning and maintenance options is a highly advantageous feature over the prior art 202.

Further advantageous may be the low profile style of the deck drain system 100. Deck drain system 100 should be narrow in an effort to minimize the unsightly nature of conventional deck drains, for example the prior art 202. A narrow top opening 102 for a deck drain system 100 may generally not stand out for the typical pedestrian pool user and would not create such an unsightly border around the recreationally used water source as does prior art 202. A deck drain 100 having a narrow top opening 102 would likewise not reduce or impact any efficiency of water removal from a hardened deck surface 200. The prior art 202 upper opening grate may also be less advantageous in view of such a narrow top opening 102, and the structural integrity may be further enhanced by way of rib 140 instead of a large grate as seen on prior art 202. This would allow for easy cleaning and maintenance.

While particular forms of the invention have been illustrated and described, it will also be apparent to those skilled in the art that various modifications can be made without departing from the spirit and scope of the invention.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference. Insofar as the description above and the accompanying drawings disclose any additional subject matter that is not within the scope of the claims below, the inventions are not dedicated to the public and the right to file one or more applications to claim such additional inventions is reserved.

What is claimed is:

1. A modular deck drain system comprising:

a) a bottom channel having:

i) a pair of opposed side walls, an open top and a bottom surface;

ii) a plurality of stabilizing members coupled to and extending from an external surface of the bottom channel; and iii) at least one modular junction node;

b) an upper cover configured to couple to the bottom channel, the upper cover having:
   i) two upper walls, each wall having a top end and a bottom end, the top end of each wall coupled to an upper lip;
   ii) a narrow top opening formed by the upper lips; and
   iii) at least one cutline; and
   iv) a plurality of upper cover fill holes spaced along the upper walls, the fill holes configured to retain decking material, each fill hole having an open top and a closed bottom.

2. The system of claim 1, wherein modular junction node comprises at least two modular junction fasteners coupled to an end of the bottom channel.

3. The system of claim 1, wherein modular junction node comprises at least two modular junction receivers coupled to an end of the bottom channel.

4. The system of claim 1, further comprising an outflow aperture coupled to at least one end of the bottom channel.

5. The system of claim 4, further comprising a female spigot coupled to the outflow aperture.

6. The system of claim 4, further comprising a male spigot coupled to the outflow aperture.

7. The system of claim 1, wherein the upper cover further comprises:
   i) a plurality of upper cover mounting apertures spaced along the upper walls; and
   ii) a plurality of upper cover fasteners for placement within the upper cover mounting apertures.

8. The system of claim 7, wherein the bottom channel further comprises a plurality of fastener points spaced along the bottom channel.

9. The system of claim 1, further comprising a shield for removably coupling to the top opening in the upper cover, the shield configured to rest within and seal the top opening.

10. The system of claim 1, wherein the bottom surface of the bottom channel is curved.

11. The system of claim 1, wherein the upper walls of the upper cover are slanted.

12. The system of claim 1, wherein the upper cover further comprises at least one cut line.

13. A method of installing a modular deck drain system, the method comprising the steps of:
   a) providing the modular deck drain system, the system comprising:
      i) a bottom channel having:
         1) a pair of opposed side walls, an open top and a bottom surface;
         2) a plurality of stabilizing members coupled to and extending from an external surface of the bottom channel; and
         3) at least one modular junction node;
      ii) an upper cover configured to couple to the bottom channel, the upper cover having:
         1) two upper walls, each wall having a top end and a bottom end, the top end of each wall coupled to an upper lip;
         2) a narrow top opening formed by the upper lips;
         3) at least one cutline; and
         4) a plurality of upper cover fill holes spaced along the upper walls, the fill holes configured to retain decking material, each fill hole having an open top and a closed bottom:
   b) cutting the system along the cutline; and
   c) forming a corner using the cut system.

* * * * *